United States Patent [19]

Houck, Jr.

[11] Patent Number: 4,756,094

[45] **Date of Patent: * Jul. 12, 1988**

[54] SURFACE MOUNTABLE AIR TOWEL

[75] Inventor: Jasper C. Houck, Jr., Oklahoma City, Okla.

[73] Assignee: Glenn Melvan Houck, Oklahoma City, Okla.

[ * ] Notice: The portion of the term of this patent subsequent to Jun. 17, 2003 has been disclaimed.

[21] Appl. No.: 60,493

[22] Filed: Jun. 9, 1987

Related U.S. Application Data

[63] Continuation-in-part of Ser. No. 873,546, Jun. 12, 1986, Pat. No. 4,685,222, which is a continuation-in-part of Ser. No. 666,674, Oct. 31, 1984, Pat. No. 4,594,797.

[51] Int. Cl.[4] ..... F26B 19/00

[52] U.S. Cl. ..... 34/225; 34/233; 34/243 R

[58] Field of Search ..... 34/225, 229, 222, 233, 34/243 C, 243 R

[56] References Cited

U.S. PATENT DOCUMENTS

| | | | |
|---|---|---|---|
| 2,977,455 | 3/1961 | Murphy | 219/39 |
| 3,128,161 | 4/1964 | Hudon | 34/233 |
| 3,409,995 | 11/1968 | Greenwood et al. | 34/243 |
| 3,449,838 | 6/1969 | Chancellor, Jr. | 34/233 |
| 3,621,199 | 11/1971 | Goldstein | 219/370 |
| 3,711,958 | 1/1973 | Lepage | 34/88 |
| 3,878,621 | 4/1975 | Duerre | 34/233 |
| 4,594,797 | 6/1986 | Houck, Jr. | 34/225 |
| 4,685,222 | 8/1987 | Houck, Jr. | 34/229 |

*Primary Examiner*—Larry I. Schwartz

*Attorney, Agent, or Firm*—Fisher, Christen & Sabol

[57] ABSTRACT

A surface mountable device for drying bathers has an enclosed, vertically or horizontally oriented chamber. An elongated air passageway is located on the front of the chamber. Means for providing drying air is attached to one end of the chamber. The chamber has cross sections which diminish from the end attached to the means for providing drying air to the opposite end. The cover has attachment means for attaching the device to a desired surface, obviating the necessity for recessing the device in the surface.

21 Claims, 4 Drawing Sheets

SURFACE MOUNTABLE AIR TOWEL

BACKGROUND OF THE INVENTION

This is a continuation-in-part of application Ser. No. 873,546 filed June 12, 1986, now U.S. Pat. No. 4,685,222, which is a continuation-in-part of application Ser. No. 666,674 filed Oct. 31, 1984, now U.S. Pat. No. 4,594,797.

This invention relates to an air heater and blower assembly for discharging air at a generally uniform velocity along the length of an elongated slot. More in particular the invention relates to a surface mounted apparatus for drying large wet surfaces such as the full human torso upon bathing.

It is well known to use portable air heaters and blowers to discharge air at a relatively high velocity for drying. For example, portable hair and hand dryers are of this type.

It is also known, from U.S. Pat. No. 3,878,621, to Duerre, to use a heater in a bathroom having elongated slots for drying the human body and hair.

It is also known to use a flexible hose in combination with an air heater and blower as shown in U.S. Pat. No. 3,449,838, to Chancellor, Jr. Another type of body drying apparatus is shown in U.S. Pat. No. 3,621,199 to Goldstein. Here, the whole body of a person may be dried by the passage of hot air; a deflector is arranged to deflect a stream of hot air from an outlet, the deflector being oscillated so as to cause the stream of air to sweep upward and downward over the body.

Other U.S. patents relate to an after-shower body dryer, as shown in the patent to Hudon, U.S. Pat. No. 3,128,161 showing a plurality of heated air outlets with air being heated by an element and a blower being arranged in a conduit to provide the air supply. In U.S. Pat. No. 2,977,455 to Murphy, a body dryer is shown having an electrical heating element, switches arranged together with other structure for use in blowing heated air across a human body. A perforated plate is used to distribute the air across a central portion of the plate.

In another type of device, heated air is used in combination with a blower to inflate generally flexible, flaccid bag members so as to rub against the body of a person, the bag being generally absorbant and porous. Here, contact of a human body with the bag while the bag is inflated with heated air, causes drying by physical contact of the bag member with the body together with air flow carrying moisture away from the bag member. Some convection moisture removal will be caused by the generally low air flow speed through the bag member, however, this is not the primary drying mode.

SUMMARY OF INVENTION

The invention is an apparatus for providing drying air which might be used in place of a towel for drying off after taking a shower, hence, the commercial name of the invention is AIR TOWEL TM. The invention is for drying an entire person rather than portions of a body, such as hands, feet, or hair; however, it can be constructed to dry such portions. The invention is constructed to be mounted on a surface without having to recess the unit into a mounting surface.

The invention comprises three elements. Means for providing air for drying is located preferably above the unit and more preferably within the ceiling above the invention. The means for providing air includes a vent for supplying air, a heater for heating the air, and a blower for providing a flow of air.

An elongated chamber is attached to the means for providing air. The elongated chamber has a diminishing cross section from a point of attachment to the means for providing air to a distal most point from the means for providing air. The tapered chamber is provided with an elongated passageway formed on one wall of the chamber which provides a passageway for air flowing out of the chamber and into exterior areas where people can position themselves for receiving drying air. The chamber is preferably composed of a front and a back, both of which have side walls which can overlap to provide an enclosed chamber. The front and back of the chamber fit together much akin to a shoe-box top fitting on a shoe-box. The front of the chamber is provided with the passageway which is an elongated slot about four or more feet in length. Air flowing into the chamber from the means for providing air will exit the chamber through the passageway in a generally uniform rate all along the length of the passageway because of the diminishing cross section of the chamber. Thus, a wet person desiring to get dried needs to merely position himself in front of the passageway and air exiting the entire length of the passageway will provide a flow of air upon a substantial portion of the length of the person.

Means are provided for connecting the AIR TOWEL TM to a mounting surface. Preferably the means for attachment is a cover for the chamber. Situated upon the cover is an elongated slot coextensive with the chamber's passageway. The cover is provided with side edges which are substantially coplanar with the back of the chamber. Fasteners may be used to attach the side edges to the mounting surface. The cover preferably has a recess located on the cover which is adjacent to the air passageway. Lying within the recess is a flexible hose which has an inlet connected to the means for supplying air. The hose has an outlet where nozzle means is attached. The nozzle means is used for directing a flow of air to a limited amount of area such as, for example, hair. When the flexible hose is not being used it lies within the recess located on the cover. Also on the cover is located an actuator for the means for providing the air. The actuator is preferably a button to actuate the blower-heating elements to start the flow of air. Preferably, a pneumatic line sends a signal to a conventional temperature controller to actuate a relay which would close a circuit to selectively turn on or off the blower and heater elements. A control line communicates a control signal to an electrical supply which powers the motor. The material composing the air chamber and cover is preferably an electrically insulated material such as a thermoplastic.

It is an object of the invention to provide an easily installed surface mountable apparatus for drying large surface areas such as a human or animal torso.

These and other and further objects and features of the invention are apparent in the disclosure, which includes the foregoing and following specification, claims and drawings.

BRIEF DESCRIPTION OF THE DRAWINGS

While the specification concludes with claims particularly pointing out and distinctively claiming the subject matter that is regarded as forming the present invention, it is believed that the invention will be better understood from the following description accompanied by the following drawings in which:

DESCRIPTION OF THE PREFERRED EMBODIMENTS

Figure 1:
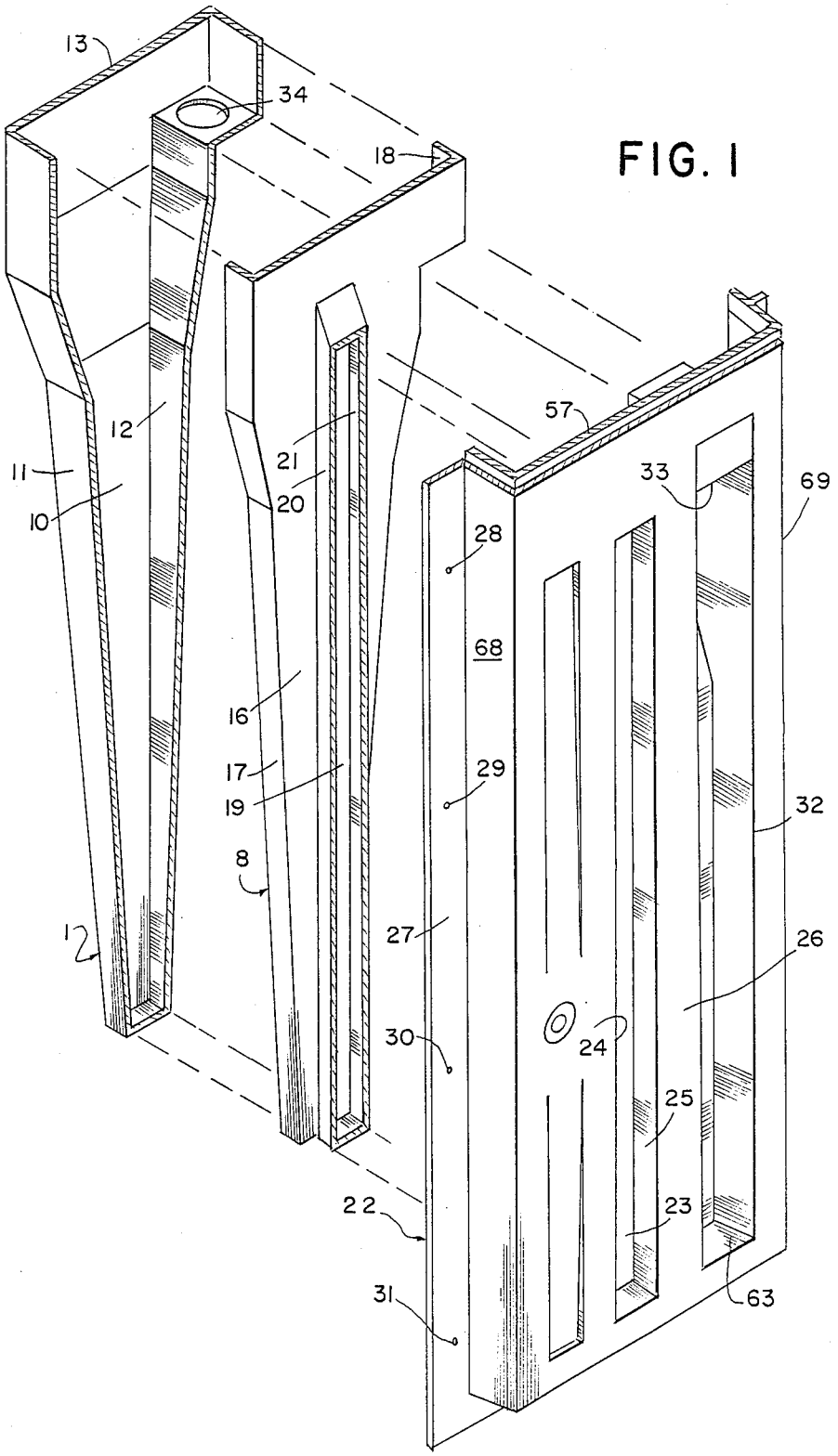
FIG. 1 is an elevated exploded perspective of the invention.

The best mode for practicing the invention is set out in FIG. 1. The surface-mountable apparatus for drying is shown in the elevated exploded perspective as having three parts. Part 1 is the back of the surface-mountable unit and is shown as having planar surface 10 having lateral sides 11 and 12 bent perpendicular to planar surface 10. Planar surface 10 is shown as being wider at end 13 than end 14. End 14 has side 15 which is bent perpendicular to the planar surface 10. End 13 is shown as being open.

Piece 8 provides the front of the chamber. Piece 8 has a planar surface 16 which has lateral sides 17 and 18 which are bent perpendicular to the planar surface 16. The front of the chamber 8 fits to chamber 1 so that the lateral sides 11, 12, 17, and 18 connect. The lateral sides maintain the planar surfaces 10 and 16 in mutually spaced relationship. It is to be noted that the lateral sides may be connected by any suitable means. Such means can be welding, glueing, fastening with threaded fasteners, or interference fittings. A combination of connecting means may be used to connect the lateral sides. For example, lateral side 17 can overlap lateral side 11 and glueing or heat bonding can be used to further secure the interference fit. The lateral side 18 may overlap lateral side 12 in similar fashion.

The back 1 and the front 8 when pieced together form the chamber for the drying apparatus. The tapering sides of planar surfaces 10 and 16 give the chamber 1, 8 a generally diminishing cross section from end 13 to end 14.

The front 8 of the chamber is provided with an elongated passageway 19. The passageway 19 provides an air outlet for the chamber, 1 and 8. Air entering the inlet of chamber 1,8 at the wider end 13 exits the chamber through passageway 19. Air departing from the chamber through passageway 19 has a constant velocity all along the length of the passageway 19 because of the diminishing cross sectional areas of the chamber 1,8.

The passageway 19 is shown as having sides 20 and 21 which project from planar surface 16 in a perpendicular fashion but may also be venturied or angled. It is to be noted that the sides of passageway 19 do not have to project outward from the planar surface 9 as illustrated with sides 20 and 21. The invention can be practiced quite easily by having passageway 19 be an elongated through-hole in planar surface 16. Cover 22 is provided for encasing chamber 1,8 and for attaching chamber 1,2 to a surface. Cover 22 is adapted to fit over back 1 and front 8 such that the hole 23 on cover 22 is coextensive with the passageway 19 on front 8. Cover 22 has sides 24 and 25 which are bent perpendicular to the planar surface 26 but may also be venturied or angled. The cover 22 is attached to the chamber 1,8 by connecting sides 24 and 25 to sides 20 and 21 in a fashion similar to the way sides 17 and 18 are connected to sides 11 and 12. It is to be noted that sides 20, 21 and 24, 25 can be eliminated so that planar surface 16 can be attached to the back of planar surface 26 such that hole 23 is coextensive with passageway 19. The cover 22 may also be bonded to portions surrounding hole 34.

Cover 22 is provided with an edge 27 which forms a border around cover 22. When cover 22 is attached to chamber 1,8, edge 27 is substantially coplanar with the back planar surface 10. Holes 28, 29, 30, and 31 located on edge 27 are adapted to receive fastening means for attaching the cover 22 to a surface. Any kind of fastening means may be used to attach cover 22 to a surface. Such fastening means may be nails, screws, bolts, molly bolts, rivets, hooks, etc. The fastening means will vary with the type of surface. For example, tile surfaces will require different fastening means than gypsum board.

Figure 2:
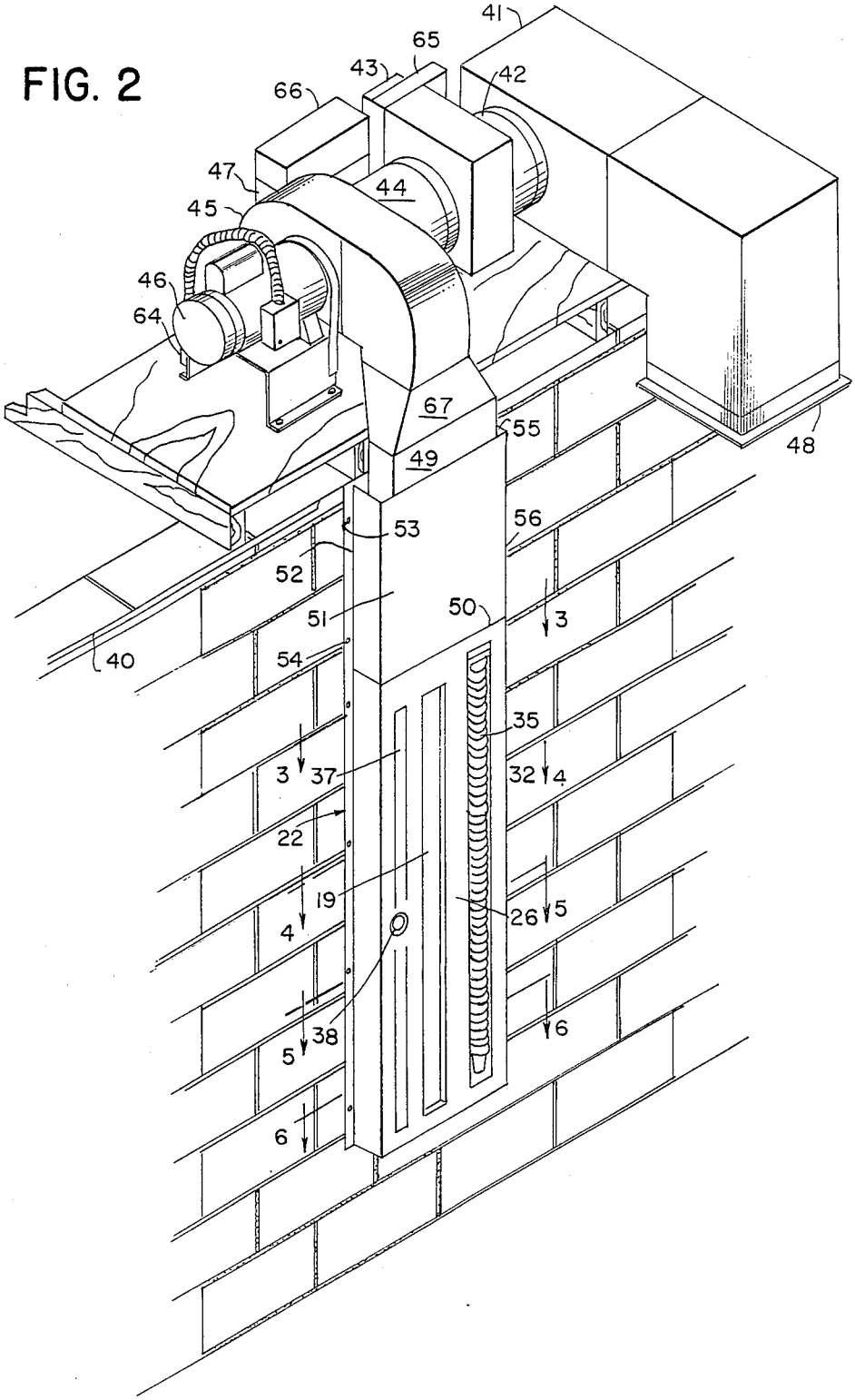
FIG. 2 is an elevated perspective showing the invention in partial cutaway.

Cover 22 is also provided with a recess 32 which is shown as being elongated. The recess 32 has a first end 33 and a second end 63. The first end 33 is open, (not shown). The opening is in communication with hole 34 located on back 1. FIG. 2 shows a flexible hose 35 lying within recess 32 wherein the hose 35 is connected to end 33 and thus to hole 34. FIG. 2 also shows hose 35 having nozzle means 36 for controlling the direction and flow of air through hose 35.

Cover 22 also shows another recessed area 37 which has been added to cover 22 for aesthetic purposes. Located on recess 37 is actuating means 38. The actuating means 38 can be a button provided to actuate the blower and heating means to provide air to the chamber 1,8. The actuation is more fully disclosed in commonly owned U.S. Pat. No. 4,594,797 issued to Houck, Jr. which is hereby incorporated in its entirety herein.

Figure 8:
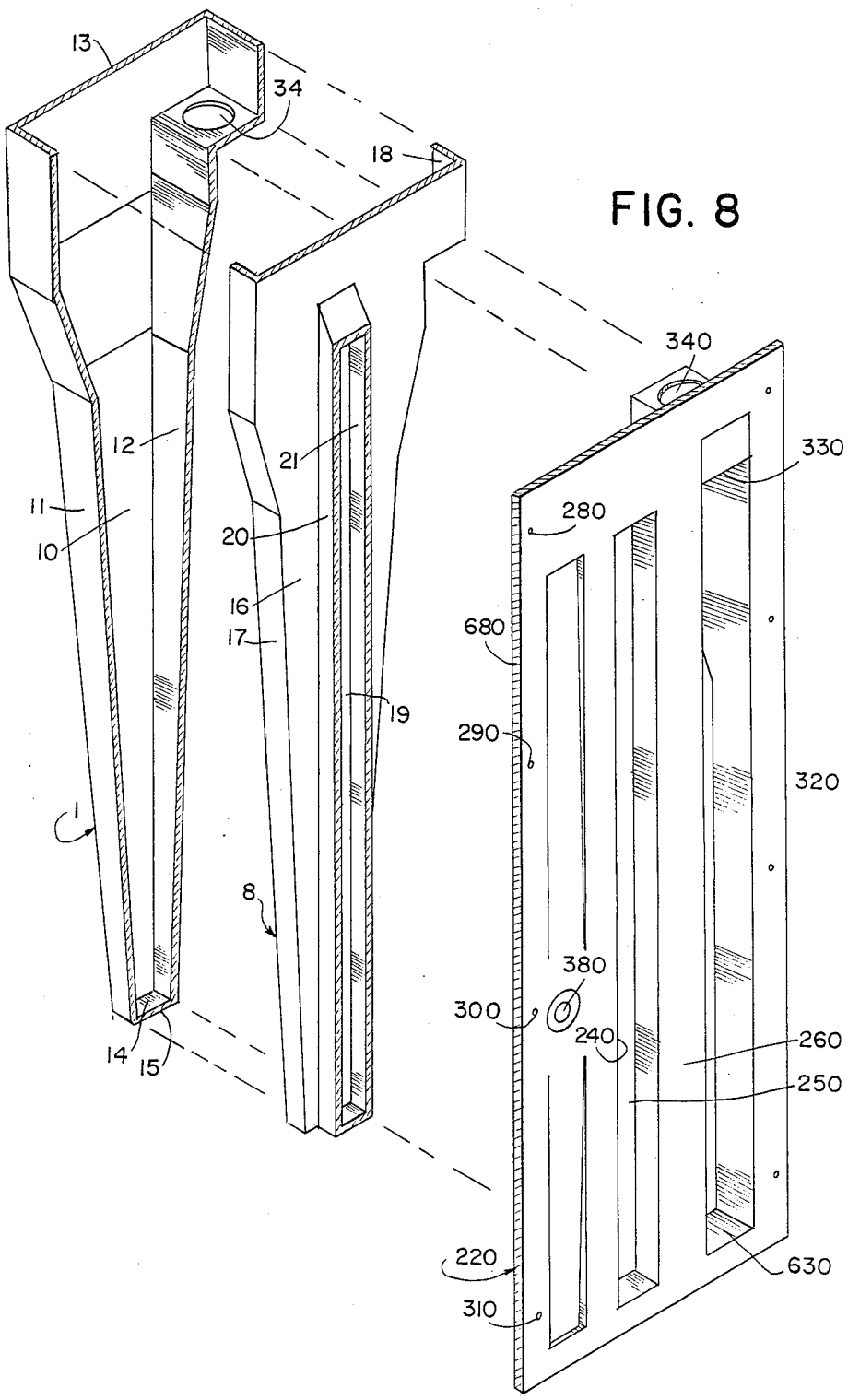
FIG. 8 is an elevated perspective of an alternative embodiment of cover 22 from FIG. 1.

FIG. 8 shows an alternative embodiment to cover 22 as shown in FIG. 1. The cover 220 of FIG. 8 is preferred when the invention is to be recessed in a mounting surface such that the planar surface 260 is substantially coplanar with the mounting surface, i.e., flush mounted. The edges 27 and 57 of FIG. 1 is not necessary for the embodiment of FIG. 8, and therefore is left off cover 220.

Preferably, a hole is cut in the mounting surface to accomodate the air chamber 1,8 so that sides 680 and 690 fit flush to the surface on which the cover 220 is mounted. Fastening means are used in conjunction with holes 280, 290, 300 and 310 for attaching cover 220 to the mounting surface. All other structures on cover 220 are substantially the same as on cover 22.

FIG. 2 is a elevated perspective view of the invention as it would be seen attached to a mounting surface such as a wall. FIG. 2 is shown in partial cutaway for clarity of disclosure.

As can be seen, cover 22 is visible and back 1 and front 8 are encased therein. Cover 22 is attached to mounting surface 39 in FIG. 7. The invention is simply attached to a surface so that air passageway 19 discharges the air in the preferred direction. It is preferable that air passageway 19 be arranged so as to provide a flow of air along a substantial portion of a torso. Air hose 35 is shown as resting within recess 32.

Figures 3, 4, 5, 6, 7:
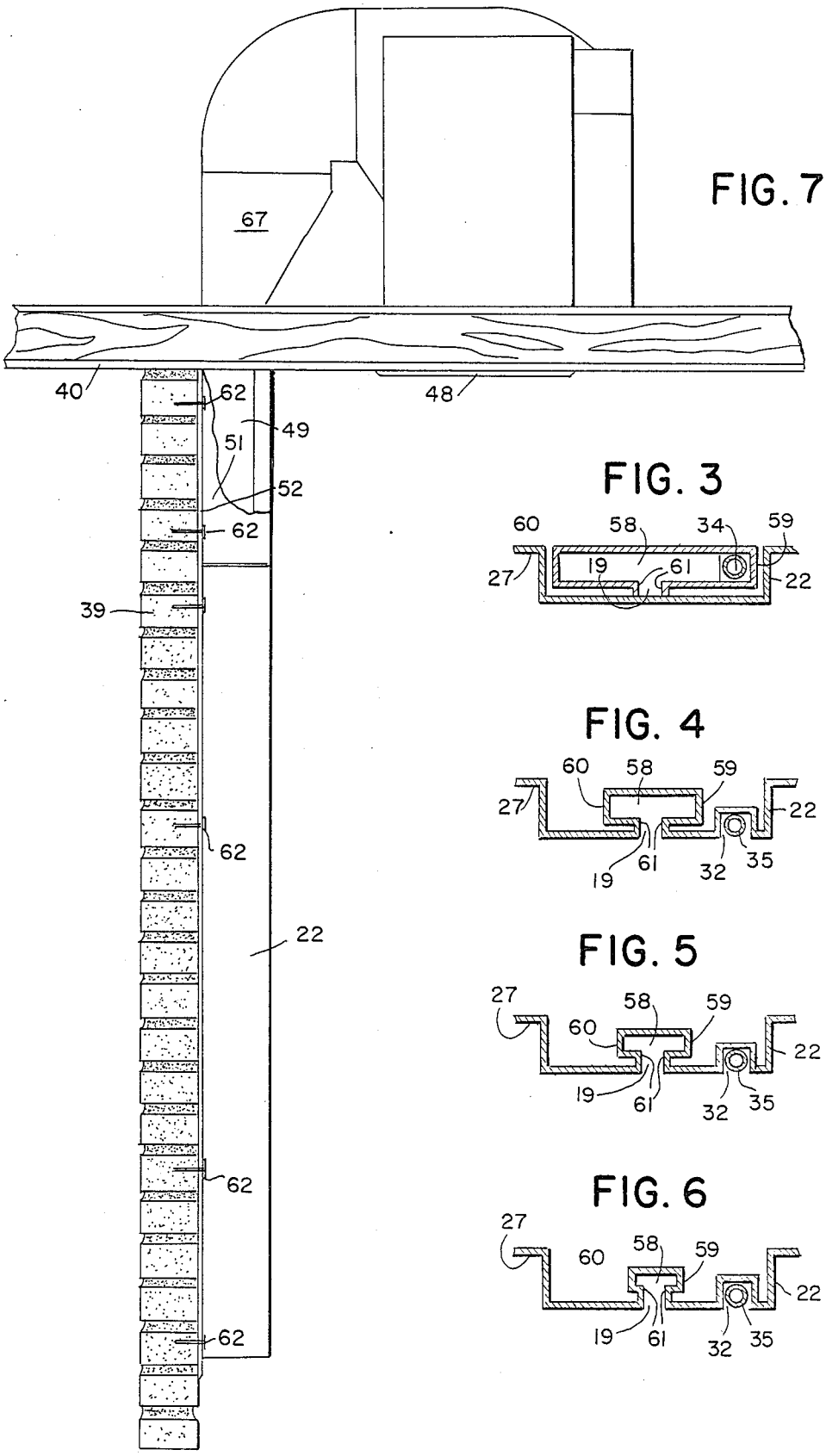
FIG. 3 is a cross-sectional view taken from line 3—3 on FIG. 2.
FIG. 4 is a cross-sectional view taken from line 4—4 on FIG. 2.
FIG. 5 is a cross-sectional view taken from line 5—5 on FIG. 2.
FIG. 6 is a cross-sectional view taken from line 6—6 on FIG. 2.
FIG. 7 is an elevated side plan view of the invention in partial cutaway.

The invention is usually mounted below a ceiling 40 as shown in FIG. 2 and FIG. 7. Means for providing air 41, 42, 43, 44, 45, 46, and 47 is situated in an out-of-the-way place such as above ceiling 40. Ductwork 49 depends from the ceiling 40 and attaches to the invention at or about point 50. The ductwork 49 is provided with a cover 51 which preferably matches the cover 22 to provide a uniform aesthetic appearance. Cover 51 is provided with attaching means 52. Attaching means 52 is an edge corresponding to edge 27 and has holes 53, 54, 55, and 56 for attachment to mounting surface 39 by any fastening means. FIG. 1 shows the ledge 57 on cover 22 for receiving in overlapping relationship a portion of cover 51. Other methods for connecting cover 22 with cover 51 may be used; however, it is preferred that all visible portions of the invention fit together in a cooperative relation providing for aesthetics as well as for functionality.

The means for providing heated air is best shown in FIG. 2. The return air grill 48 provides communication between an area containing air and the air plenum 41 which is preferably a sheet metal duct work. Air duct 42 provides communication between the air plenum 41 and the heating element 43. Air duct 44 provides communication between heating unit 43 and blower 45. The control box 47 contains the electronics for actuating the invention. Wires are shown running from control box 47 to access plates 64 and 65 on the motor 46 and heating element 43, respectively. Duct work 67 channels air from the blower 45 to duct work 49 which in turn is connected to chamber 58. (see FIGS. 3, 4, 5 and 6.)

In operation, air is drawn into air plenum 41 through return air grill 48, by way of blower 45 forcing air downward through ducts 67 and 49. Air flows through duct 42 where it is heated by the heating element in heating unit 43. Heated air then flows through duct 44, blower 45, ducts 67 and 49, and out passageway 19 and/or nozzle 36.

Actuating means 38 is a pneumatic button connected to control box 47 preferably by a ¼" diameter hose. Air forced through the hose (not shown) activates the switches for the motor and heating elements. Quick disconnect switch 66 is provided for safety purposes when maintenance is required. When the desired heat is attained, the heat can be turned off by pushing the pneumatic button. Air continues to flow until the drying cycle is completed.

FIGS. 3, 4, 5, and 6 show one of the salient features of the invention. The chamber space itself is denoted by the number 58. FIG. 3 is a cross section taken from about the top of the invention where the chamber is shown to extend from side 59 to side 60. It is to be noted that sides 59 and 60 are where back 1 and front 8 connect. There is also connection 61 connecting the air chamber 58 to cover 22. Also shown is edge 27 for attaching the invention to mounting surface 39. Air passageway 19 is shown as being blocked by cover 22.

FIG. 4 is another cross section of the invention disclosed in FIG. 2 taken at line 4—4. The chamber space 58 is shown as having a diminished cross section when compared to FIG. 3. The passageway 19 opens to exterior areas. Instead of the hose attachment hole 34 as shown in FIGS. 1 and 3, FIG. 4,5 and 6 show hose 35 hanging in recess 32.

FIG. 5 is yet another cross section of the invention as disclosed in FIG. 2 taken along line 5—5. The chamber 58 is shown as being even more diminished in cross section when compared to the chamber space of FIG. 4.

FIG. 6 is still another cross section of the invention as disclosed in FIG. 2 taken along line 6—6 of FIG. 2. The chamber space 58 is even more diminished in cross section as compared to the other FIGS. 3 thru 5. The invention achieves a generally uniform rate of flow of air traveling through passageway 19 from chamber space 58 all along the length of passageway 19. That is to say, the air departing passageway 19 in FIG. 6 has the same general rate of flow as air departing passageway 19 in FIG. 4.

FIG. 7 is an elevated side plan view of the invention shown attached to a mounting surface such as a wall. Covers 51 and 22 are shown with their edges 52 and 27 being attached to a mounting surface such as wall 39 by way of fasteners 62. The fasteners may by any kind of fasteners. The ductwork 49 is shown as depending from the ceiling 40. The vent 48 is shown as providing the supply of air used to flow through the chamber 58.

The preferred material for constructing the components of the air chamber is a moldable thermoplastic. Back 1, front 8, and cover 22 are preferably all made from a thermoplastic material. It is conceivable that back 1, front 8 and cover 22 may all be molded as one piece. It is preferred, however, that the back, front, and cover be constructed of 3 separate pieces of material. The back 1 and front 8 can be used for a unit which is to be recessed into a mounting surface. It should be noted however, that the more convenient surfaces for providing the invention often times do not allow for a recessed embodiment of this invention. Such surfaces are brick, tile, concrete, etc. The surface-mounted unit as presently disclosed is for such instances where fast and easy installment is desired.

One of the most convenient ways for making the components 1, 8, and 22 of the invention is by thermoforming. Sheets of ABS material (acrylonitrile, butadiene, styrene) are deformed by hot presses into desirable shapes. The ABS material can be anywhere from 3/16" thick to pieces much thicker. The material has a fire retardant plastic filler, mechanical toughness for impact which remains to minus −60° F. and has chemical resistance.

The invention is referred to as an AIR TOWEL TM. Installation of the surface mountable unit is simple. The blower motor unit 41, 42, 43, 44, 45, 46, 47 and optionally 48 is mounted on a platform in the ceiling; however, it can be mounted in other locations. Ductwork is attached to the blower motor unit and the AIR TOWEL TM. The AIR TOWEL TM is attached to a mounting surface in close proximity to bathing areas.

The invention is not limited in size. It is conceivable that it can be reduced in size and mounted for use as a hand dryer. The invention is advantageous over present hand dryers because the invention, even if only provided with about a 10" slot provides more air per surface area to be dried than conventional hand dryers. It is conceivable the invention can be enlarged to dry large animals, e.g., horses.

As this invention may be embodied in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What is claimed is:

1. An apparatus for providing drying air which is mountable on a surface, comprising:

(a) means for providing controlled temperature air;

(b) a chamber having first and second ends and having a front and a back, wherein said first end is in communication with said means for providing air, said chamber having an increasingly diminishing cross section from said first end to said second end, said chamber being further provided with an elongated passageway on said front communicating with exterior drying areas, said passageway having a uniform width along a longitudinal length, whereby air departing the chamber through the passageway has a generally uniform velocity along the length of the passageway; and (c) attachment means for attaching said apparatus to a mounting surface, whereby a device for providing drying air is provided which is mountable upon a desired surface.

2. The apparatus of claim 1 where said chamber further comprises a cover for said chamber, said cover having a hole coextensive with said passageway.

3. The apparatus of claim 2 wherein said attachment means is an edge outwardly projecting from said cover, said edge being substantially coplanar with said back.

4. The apparatus of claim 3 wherein said edge projects from side portions of said cover.

5. The apparatus of claim 4 wherein said cover has a recessed area adapted to receive an air hose, said recessed area having first and second ends, wherein said first end of said recessed area is in communication with said means for providing air.

6. The apparatus of claim 5 further comprising a flexible air hose for controlling and directing air flow, said hose having an inlet attached to said first end of said recessed area, said hose laying within said recessed area when not in use.

7. The apparatus of claim 6 further comprising actuating means located on said cover for operating said means for providing air without obtaining an electric shock.

8. The apparatus of claim 7 where said back comprises a first planar surface having lateral sides bent substantially perpendicular to said first planar surface and where said front comprises a second planar surface having lateral sides bent substantially perpendicular to said second planar surface, wherein said chamber has said first planar surface being connected to said second planar surface at overlapping portions of the lateral sides, said lateral sides maintaining the planar surfaces in mutually spaced relationship.

9. The apparatus of claim 8 wherein said apparatus is constructed from moldable thermoplastic resin.

10. An apparatus for providing drying air which is mountable on a desired surface, comprising:

(a) means for providing controlled temperature air;

(b) a chamber having first and second ends and having a front and a back, wherein said front end is in communication with said means for providing air, said chamber having an increasing diminishing cross section from said first end to said second end, said chamber being further provided with an elongated passageway on said front communicating with exterior drying areas, said passageway having a uniform width along a longitudinal length whereby air departing the chamber through the passageway has a generally uniform velocity along the length of the passageway, said back comprising a first planar surface having lateral sides bent substantially perpendicular to said first planar surface and said front comprising a second planar surface having lateral sides bent substantially perpendicular to said second planar surface, where said chamber comprises said first planar surface being connected to said second planar surface at overlapping portions of the lateral sides, said lateral sides maintaining the planar surfaces in mutually spaced relationship;

(c) attachment means for attaching said apparatus to a mounting surface, whereby a device for providing drying air is provided which is mountable upon a desired surface, said attachment means being an edge outwardly projecting from said chamber, said edge being substantially coplanar with said back.

11. The apparatus of claim 10 where said chamber further comprises a cover for said chamber, said cover having a hole coextensive with said passageway.

12. The apparatus of claim 11 wherein said edge projects from side portions of said cover.

13. The apparatus of claim 12 wherein said cover has a recessed area adapted to receive an air hose, said recessed area having first and second ends, wherein said first end of said recessed area is in communication with said means for providing air.

14. The apparatus of claim 13 further comprising a flexible air hose for controlling and directing air flow, said hose having an inlet attached to said first end of said recessed area, said hose laying within said recessed area when not in use.

15. The apparatus of claim 14 further comprising actuating means located on said cover for operating said means for providing air without obtaining an electric shock.

16. The apparatus of claim 15 where said edge further comprises fastening means for attaching said edge to said mounting surface, whereby said apparatus is mounted.

17. An apparatus for providing drying air which is mountable on a desired surface, comprising:

(a) means for providing controlled temperature air;

(b) a vertically oriented chamber having first and second ends and having a front and a back, wherein said first end is communication with said means for providing air, said chamber having an increasingly diminishing cross section from said first end to said second end, said chamber being further provided with an elongated vertically oriented passageway on said front communicating with exterior drying areas, said passageway having a uniform width along a longitudinal length, whereby air departing the chamber through the passageway has a generally uniform velocity along the length of the passageway, said back comprising a first planar surface having lateral sides bent substantially perpendicular to said first planar surface and said front comprising a second planar surface having lateral sides bent substantially perpendicular to said second planar surface, said chamber comprising said first planar surface being connected to said second planar surface at overlapping portions of the lateral sides, said lateral sides maintaining the planar surfaces in mutually spaced relationship, said chamber further comprising a cover for said chamber, said cover having a hole coextensive with said passageway, said cover having a recessed area adapted to receive an air hose, said recessed area having first and second ends, wherein said first end of said recessed area is in communication with said means for providing air;

(c) attachment means for attaching said apparatus to a mounting surface, whereby a device for providing drying air is provided which is mountable upon a desired surface, said attachment means being an edge outwardly projecting from said cover, said edge being substantially coplanar with said back, said edge further comprising fastening means for connecting said edge to said mounting surface.

18. The apparatus of claim 17 further comprising a flexible hose having an inlet and an outlet, wherein said inlet is connected to said first end of said recessed area, said hose laying within said recessed area when not in use.

19. The apparatus of claim 18 wherein said apparatus is constructed from moldable thermoplastic resin.

20. The apparatus of claim 19 wherein said means for providing air comprises heating means for heating the air and blower means for creating flow of air.

21. An apparatus for providing drying air which is mountable on a desired surface, comprising:

(a) means for providing controlled temperature air;

(b) a chamber having first and second ends and having a front and a back, wherein said first end is in communication with said means for providing air, said chamber having an increasingly deminished cross section from said first end to said second end, said chamber being further provided with an elongated passageway on said front communicating with exterior drying areas, said passageway having a uniform width along a longitudinal length, whereby air departing the chamber through the passageway has a generally uniform velocity along the length of the passageway; and (c) a cover encasing the chamber having a hole extending therethrough which is coextensive with the passageway, the cover being adapted to be recessed to a mounting surface.

* * * * *